United States Patent [19]

Tanabe et al.

[11] Patent Number: 4,980,699

[45] Date of Patent: Dec. 25, 1990

[54] LIQUID INJECTION RECORDING METHOD FOR ACCURATELY PRODUCING AN IMAGE REGARDLESS OF AMBIENT TEMPERATURE

[75] Inventors: Sakiko Tanabe, Tokyo; Junji Shimoda, Chigasaki; Toshiaki Hirosawa, Hiratsuka, all of Japan

[73] Assignee: Canon Kabushiki Kaisha, Tokyo, Japan

[21] Appl. No.: 425,391

[22] Filed: Oct. 23, 1989

Related U.S. Application Data

[63] Continuation of Ser. No. 132,893, Dec. 14, 1987, abandoned.

[30] Foreign Application Priority Data

Dec. 17, 1986 [JP] Japan ..... 61-302675

[51] Int. Cl.[5] ..... B41J 2/045

[52] U.S. Cl. ..... 346/1.1; 310/315; 346/140 R

[58] Field of Search ..... 346/1.1, 140; 310/315, 310/317

[56] References Cited

U.S. PATENT DOCUMENTS

| | | | |
|---|---|---|---|
| 3,914,772 | 10/1975 | Kashio . | |
| 4,125,845 | 11/1978 | Stevenson | 346/140 |
| 4,126,867 | 11/1978 | Stevenson | 346/140 |
| 4,250,512 | 2/1981 | Kattner | 346/140 |
| 4,275,402 | 6/1981 | Kern | 346/140 |
| 4,284,996 | 8/1981 | Greve . | |
| 4,352,114 | 9/1982 | Kyogoku | 346/140 |
| 4,544,931 | 10/1985 | Watanabe et al. . | |
| 4,639,735 | 1/1987 | Yamamoto . | |
| 4,660,056 | 4/1987 | Yokoi . | |
| 4,714,935 | 12/1987 | Yamamoto | 346/140 |

FOREIGN PATENT DOCUMENTS

| | | |
|---|---|---|
| 0208484 | 6/1986 | European Pat. Off. . |
| 55-27210 | 2/1980 | Japan . |
| 55-65566 | 5/1980 | Japan . |
| 55-65567 | 5/1980 | Japan . |
| 56-60261 | 5/1981 | Japan . |
| 57-103854 | 6/1982 | Japan . |
| 59-3272 | 1/1984 | Japan . |
| 94356 | 5/1985 | Japan . |

*Primary Examiner*—Joseph W. Hartary

*Attorney, Agent, or Firm*—Fitzpatrick, Cella, Harper & Scinto

[57] ABSTRACT

In a liquid injection recording method, the falling time of a voltage pulse applied to electromechanical converting means for generating energy for discharging liquid droplets to a recording medium is made longer under a high temperature environment than under a room temperature environment.

16 Claims, 3 Drawing Sheets

LIQUID INJECTION RECORDING METHOD FOR ACCURATELY PRODUCING AN IMAGE REGARDLESS OF AMBIENT TEMPERATURE

This application is a continuation of application Ser. No. 07/132,893, filed Dec. 14, 1987, now abandoned.

BACKGROUND OF THE INVENTION

1. Field of the Invention

This invention relates to a liquid injection recording method, and more particularly to an on-demand type liquid injection recording method which is capable of accomplishing harmonious expression on a recording medium by the control of a voltage pulse applied to electro-mechanical converting means.

2. Related Background Art

A liquid injection recording apparatus such as an ink jet printer is instructed such that ink is supplied to a recording head and the ink in the recording head is are propelled favored a recording medium to accomplish recording.

As energy converting means for discharging the ink, there is known electro-mechanical converting means such as a piezo-electric element or electro-thermal converting means such as a heat generating resistance member in an ink discharge system utilizing heat energy.

The present invention is directed, above all, to a liquid injection recording method and apparatus using said electro-mechanical converting means.

In the liquid injection recording method of this type, there is adopted a method of disposing electro-mechanical converting means, for example, a piezo-electric element, in the circumferential wall portion of the pressure chamber, for example, of a liquid injection recording head (ink jet head), applying a voltage pulse in the direction of polarization to the piezo-electric element and abruptly reducing the volume of the pressure chamber, thereby causing liquid droplets for recording to be discharged.

FIG. 3 of the accompanying drawings shows a longitudinal cross-section of the essential portion of a recording head used in the liquid injection recording method of this type, and FIG. 4 of the accompanying drawings shows an enlarged longitudinal cross-section of the electro-mechanical converting means in FIG. 3.

In FIGS. 3 and 4, a plurality of tubular liquid flow paths 2 are connected in a sub-tank 1 and a cylindrical piezo-electric vibrator 3 is provided on the outer periphery of each liquid flow path and the end of each liquid flow path is tapered to form an ink discharge port 4, whereby the dot forming portion of the recording head is constructed.

The sub-tank 1 is connected to a main tank, not shown, through an ink supply tube 5 and connected to a suction pump and a waste liquid tank, not shown, through a suction tube 6, and is designed to maintain the level of the ink 7 therein within a predetermined range.

Said cylindrical piezo-electric element 3 is secured to the peripheral surface of said liquid flow path 2 by means of an adhesive agent 8. The liquid flow path is made of a relatively hard material such as glass or a metal to propagate the vibration of the piezo-electric vibrator 3 through the liquid (ink) in the liquid flow path 2, and constitutes a nozzle at the end thereof to form a discharge port for discharging recording dots (liquid droplets).

A filter 9 is mounted at the entrance of the liquid flow path 2 which is adjacent to the sub-tank 1 so that by providing a predetermined flow resistance, proper balance is maintained between the pressure in the direction of discharge during the discharge of liquid droplets and in the opposite direction, to thereby adjust the discharge state of liquid.

During recording, when a voltage pulse is applied to the cylindrical piezo-electric vibrator 3 to cause vibration thereof, the vibration is propagated to the liquid flow path 2, whereby the pressure of the liquid (ink) in the liquid flow path 2 is changed to permit liquid droplets to be discharged from the discharge port 4 and thus, dot recording is accomplished.

In the liquid injection recording method of this type, by varying the magnitude of the voltage of the voltage pulse applied to the piezo-electric vibrator 3 for the formation of liquid droplets, the diameter of dots on a recording medium (paper or the like) can be controlled to accomplish harmonious expression.

In this case, the greater the voltage value of the voltage pulse, the greater the dot diameter and the wider the harmony range that can be obtained.

Now, the formation of liquid droplets is subject to influence by environmental conditions, particularly, temperature. That is, when the liquid injection recording apparatus is placed under a high temperature, the viscosity of liquid becomes lower than under the normal room temperature environment and thus, the liquid droplet formation conditions change.

However, in the conventional liquid injection recording method, if the voltage value is increased to increase the dot diameter with the viscosity of liquid being reduced under a high temperature, the vibration of the meniscus surface during the discharge of liquid droplets become sufficiently vehement to cause bubbles to be produced in the liquid flow path 2 and thereby cause unstability of discharge, or cause the discharge of the phenomenon that small-diametered liquid droplets of low discharge speed after the discharge of original liquid droplets, thereby degrading the quality of recording, and this has led to the problem that the range of variation in the voltage of the voltage pulse is limited by the state of discharge in a high temperature environment and the harmony range cannot be sufficiently widened.

SUMMARY OF THE INVENTION

It is an object of the present invention to solve the above-noted problem peculiar to the prior art and to provide a liquid injection recording method which, even under a high temperature environment, ensures liquid droplet discharge as stable as that under a room temperature environment and which can accomplish recording of wide harmony range.

It is another object of the present invention to make the falling time of a voltage pulse applied to electro-mechanical converting means for generating energy for discharging liquid droplets to a recording medium longer under a high temperature environment than under a room temperature environment.

According to the liquid injection recording method of the present invention, the falling time of a voltage pulse applied to electro-mechanical converting means such as a piezo-electric vibrator for the formation of liquid droplets is longer than that of a voltage pulse applied under a room temperature environment, under a high temperature environment and therefore, even if the viscosity of liquid is reduced under high temperatures, the restoration of meniscus is gentle and inconveniences such as the introduction of bubbles and the re-discharge of small-diametered liquid droplets after the discharge of original liquid droplets are eliminated and thus, recording of high quality and of a wide harmony range can be accomplished.

DESCRIPTION OF THE PREFERRED EMBODIMENT

The method of the present invention will hereinafter be described specifically with reference to FIG. 1 and Table 1. The present invention will be described with respect to a case where a recording head of the previously described construction is used.

Figure 1:
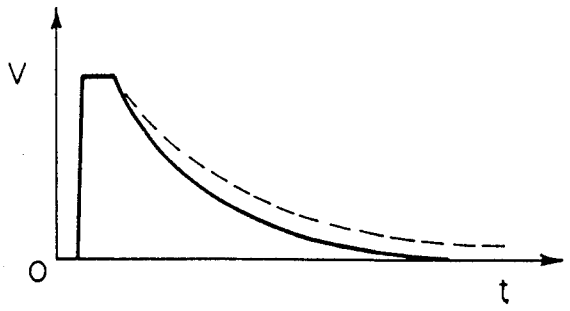
FIG. 1 is a graph showing the wave form of a voltage/pulse applied to a piezo-electric element (electro-mechanical converting means) in the method of the present invention.

FIG. 1 illustrates the wave form of a voltage pulse applied to a piezo-electric vibrator (electro-mechanical converting means) in the present invention.

In FIG. 1, the solid line shows a voltage pulse applied under a room temperature environment (25° C.), and the broken line shows a voltage pulse applied at 40° C. which is a high temperature environment.

It is to be noted that the temperatures regarded as a high temperature environment refer to temperatures higher than the standard temperature (or the room temperature). Also, the ordinate represents the voltage V and the abscissa represents time t.

Under the high temperature environment, the viscosity of liquid is generally lower than at the room temperature and therefore, if the same voltage pulse as that at the room temperature is applied, the vibration of meniscus will become vehement and bubbles will be introduced into the liquid flow path to make the discharge unstable, or the phenomenon that small-diametered liquid droplets of low discharge speed are re-discharged after the discharge of original liquid droplets will occur to readily degrade the quality of recording.

So, in the method of the present invention, as shown in FIG. 1, where a voltage pulse of the falling characteristic as indicated by the solid line is to be applied under the room temperature environment, when the environmental temperature rises, for example, to 40°, a voltage pulse of a long falling time as indicated by the broken line has been applied.

By such a method, even when the viscosity of ink became low under the high temperature environment, the restoration of meniscus could be maintained in a gentle state and the disadvantage as noted above could be eliminated and thus, stable recording of excellent quality and of a wide harmony range could be accomplished.

Table 1 shows the result of the test of the stability of ink discharge at the room temperature (25° C.) and a high temperature (40° C.).

Table 1 shows the evaluation of the stability of discharge when the 10–90% falling time was changed from the ordinary 90 μs to long 130 μs and the 3KHz discharge speed was changed to 10 m/s–16 m/s. In Table 1, the marks O show the fact that discharge continued for five minutes or longer, and the marks x show the fact that the introduction of bubbles or the phenomenon of small-diametered liquid droplets of low discharge speed being re-discharged after the discharge of original liquid droplets occurred The discharge speed changed depending on the magnitude of the applied voltage, and the discharge speed has been changed from 10 m/s to 16 m/s as the applied voltage is increased.

As is apparent from Table 1, even if the applied voltage has been in a voltage range (10 m/s–16 m/s) in which discharge is stable when the falling time (10–90%) of the voltage pulse is 90 μs at the room temperature of 25° C., when the environmental temperature has reached 40° C., the vibration of meniscus has become more vehement due to the reduction in the viscosity of liquid than at 25° C., and discharge has become unstable for a voltage of discharge speed 12 m/s or higher.

In contrast, when under a high temperature environment of 40° C., the falling time (10–90%) was extended to 130 μs, discharge could be accomplished stably up to a voltage of 16 m/s, and the stability of discharge equal to that when a voltage pulse of falling time 90 μs was applied at 25° C. could be obtained.

TABLE 1

| | | Speed | | | | | | |
|---|---|---|---|---|---|---|---|---|
| Temperature | Time | 10 | 11 | 12 | 13 | 14 | 15 | 16 |
| 25° C. | 90 μs | O | O | O | O | O | O | O |
| 40° C. | 90 μs | O | O | x | x | x | x | x |
| | 130 μs | O | O | O | O | O | O | O |

O : Good discharge for 5 minutes or more (3KHz)
x : Introduction of bubbles, re-discharge, etc.

It could be easily accomplished in the designing of the circuit to change the falling time of the voltage pulse in conformity with such an environmental temperature.

Figure 2A:
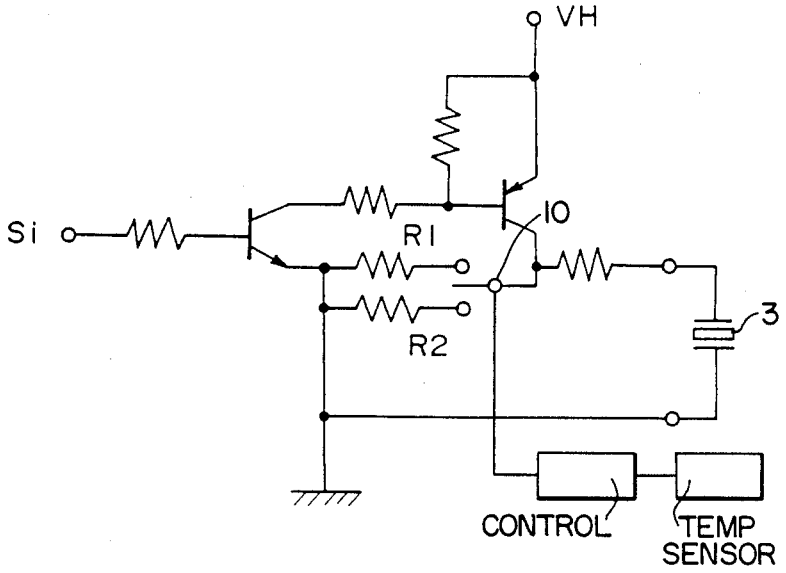
FIGS. 2A–2C are diagrams of circuits for driving the piezo-electric vibration of a liquid injection recording head suitable for carrying out the method of the present invention.
Figure 2B:
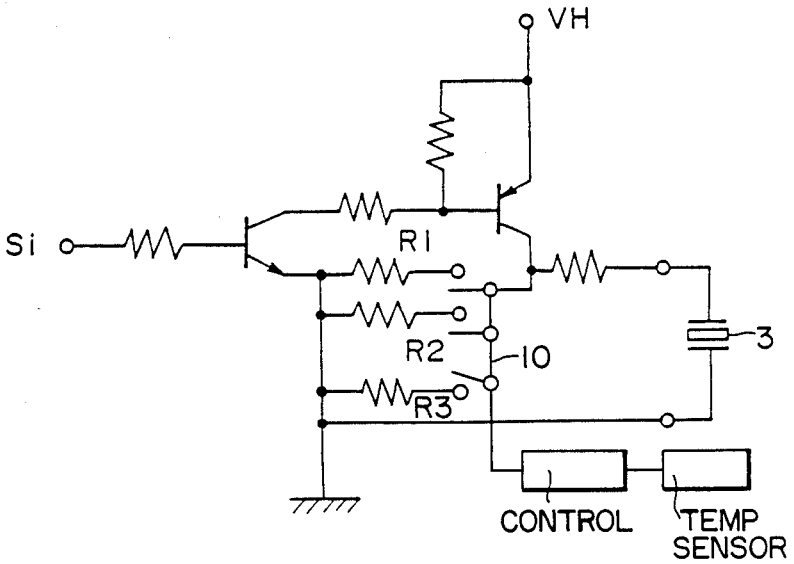
Figure 2C:
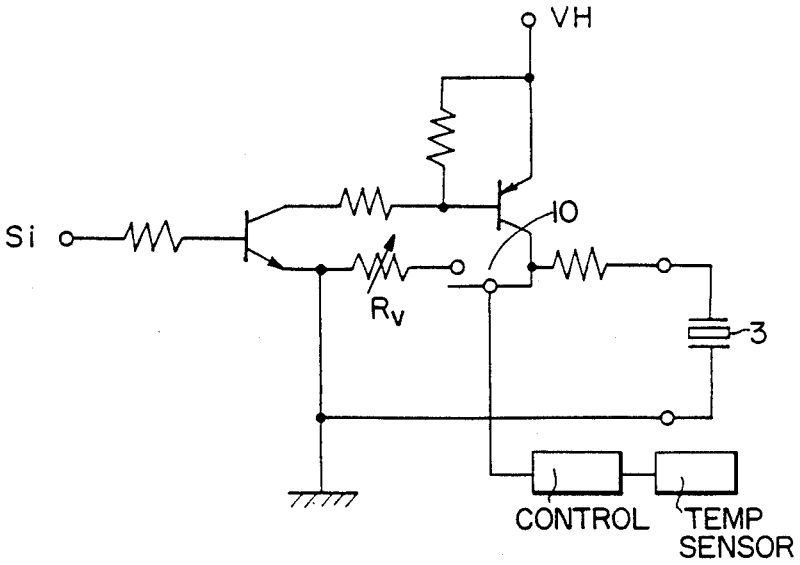
Figure 3:
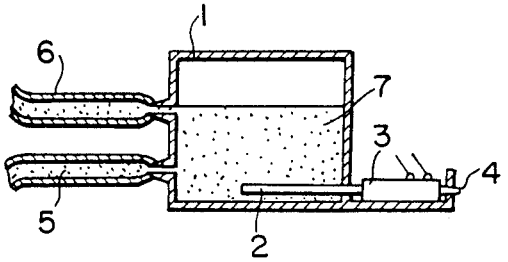
FIG. 3 PRIOR ART
FIG. 3 is a longitudinal cross-sectional view of the essential portion of a recording head used in the liquid injection recording method.
Figure 4:
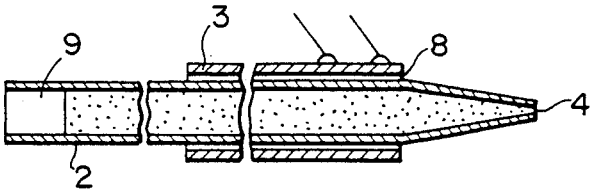
FIG. 4 PRIOR ART
FIG. 4 is an enlarged longitudinal cross-sectional view of the electro-mechanical converting means in FIG. 3.

FIGS. 2A–2C show examples of drive circuits for applying the voltage pulse to the piezo-electric vibrator of a liquid injection recording head.

In FIGS. 2A–2C, an image signal Si is produced from a control unit, not shown, in response to image information, and the voltage value of the voltage pulse is determined by the value of VH (head voltage) in the figure.

Thus, in the circuit shown in FIG. 2A, the falling time of the voltage pulse is determined by the electrostatic capacity of the piezo-electric vibrator 3 and a falling resistor R1 or R2. In the circuit shown in FIG. 2A, design has been made such that one of two kinds of falling resistors can be selected and the falling time is set by operating a change-over switch 10. The setting of this falling time is not limited to the two stages shown, but could be accomplished in a multi-stage fashion of three stages using resistors R1, R2 and R3, as shown in FIG. 2B or more or in a continuous, stageless fashion using variable resistor Rv, as shown in FIG. 2C.

The operation of the change-over switch 10 has been controlled by the detection of a temperature sensor, not shown, through a control unit, not shown.

In the test of Table 1, two resistors R1 and R2 whose falling times (10–90%) are 90 μs and 130 μs, respectively, have been prepared and use has been made of the drive circuit as shown in FIG. 2A designed such that the falling resistors are changed over at two stages with 35° C. as the boundary, and at each temperature, the most desirable falling time has been empirically found from the stability of discharge and the liquid droplet formation frequency, and as required, the number of the falling resistors has been increased and could be changed over at three or more stages or continuously in accordance with temperature.

According to the liquid injection recording method described above, when a high temperature environment has been encountered, the falling time of the voltage pulse applied to the piezo-electric vibrator 3 has been made longer than the falling time of the ordinary voltage pulse applied under the room temperature environment, whereby the restoration of meniscus in the discharge port has become gentle, and even if the viscosity of liquid was reduced by the rise of the environmental temperature, the vibration of meniscus could be prevented from becoming vehement It has therefore been possible to obtain a liquid injection recording apparatus in which there is no introduction of bubbles in a wide voltage range and there is no small-diametered liquid droplet of low discharge speed re-discharged after the discharge of original liquid droplets and stable discharge of liquid droplets can always be maintained and which is of wide harmony range and of high quality of printing.

Also, generally, the longer the falling time of the voltage pulse, the lower the liquid droplet formation frequency, but in the liquid injection recording method according to the present invention, the falling time is lengthened only when the viscosity of liquid is reduced under high temperatures and therefore, the reduction in the liquid droplet formation frequency caused by the falling time being lengthened is offset by the control for increasing the liquid droplet formation frequency with the reduction in the viscosity of liquid, whereby stable and good ink discharge could always be maintained.

As is apparent from the foregoing description, according to the present invention, there is provided a liquid injection recording method which, even under a high temperature environment, ensures liquid droplet discharge as stable as that under a room temperature environment and which can accomplish recording of wide harmony range.

We claim:

1. An ink jet recording method comprising the steps of:

providing a recording head including an energy generating element associated with a discharge port at which an ink meniscus forms, said energy generating element being capable of generating energy that discharges ink through said discharge port when a voltage pulse drives said energy generating element;

driving said energy generating element using a first voltage pulse when ambient temperature is a predetermined temperature; and driving said energy generating element using a second voltage pulse when the ambient temperature is higher than said predetermined temperature, wherein the first and second voltage pulses have different waveforms and the falling time of the second voltage pulse is longer than that of the first voltage pulse so that the second voltage pulse provides gentler restoration of the ink meniscus after ink discharge than the first voltage pulse.

2. An ink jet recording method according to claim 1, wherein the falling time of the second voltage pulse is varied in multiple steps in accordance with the ambient temperature.

3. An ink jet recording method according to claim 1, wherein the falling time of the second voltage pulse is varied continuously in accordance with the ambient temperature

4. An ink jet recording method comprising the steps of:

providing a recording head including an energy generating element associated with a discharge port at which an ink meniscus forms, said energy generating element being capable of generating energy that discharges ink through said discharge port when a voltage pulse drives said energy generating element;

driving said energy generating element using a first voltage pulse when ambient temperature is a predetermined temperature; and driving said energy generating element using a second voltage pulse when the ambient temperature is higher than said predetermined temperature, wherein the first and second voltage pulses have different waveforms and the trailing edge of the second voltage pulse has a gentler slope than that of the first voltage pulse so that the second voltage pulse provides gentler restoration of the ink meniscus after ink discharge than the first voltage pulse.

5. An ink jet recording method according to claim 4, wherein said energy generating element is an electromechanical converting element.

6. An ink jet recording method according to claim 4, wherein the trailing edge of the second voltage pulse is a falling edge.

7. An ink jet recording method according to claim 4, wherein the waveform of said first voltage pulse and the waveform of said second voltage pulse are supplied by switching two resistances each having a different resistance value.

8. An ink jet recording method according to claim 4, wherein the waveform of the first voltage pulse and the waveform of the second voltage pulse are supplied by changing a time constant.

9. An ink jet recording method according to claim 8, wherein said time constant is changed by switching resistances each having a different resistance value.

10. An ink jet recording apparatus comprising:

a recording head having an energy generating element associated with a discharge port at which an ink meniscus forms, said energy generating element being capable of generating energy that discharges ink through said discharge port;

driving voltage control means for supplying a first voltage pulse to said energy generating element when ambient temperature is a predetermined temperature and a second voltage pulse when the ambient temperature is higher than said predetermined temperature, wherein the first and second voltage pulses have different waveforms and the falling time of the second voltage pulse is longer than that of the first voltage pulse so that the second voltage pulse provides gentler restoration of the ink meniscus after ink discharge than the first voltage pulse.

11. An ink jet recording apparatus comprising:

a recording head having an energy generating element associated with a discharge port at which an ink meniscus forms, said energy generating element being capable of generating energy that discharges ink through said discharge port; and driving voltage control means for supplying a first voltage pulse to said energy generating element when ambient temperature is a predetermined temperature and a second voltage pulse when the ambient temperature is higher than said predetermined temperature, wherein the first and second voltage pulses have different waveforms and trailing edge of the second voltage pulse has a gentler slope than that of the first voltage pulse so that the second voltage pulse provides gentler restoration of the ink meniscus after ink discharge than the first voltage pulse.

12. An ink jet recording apparatus according to claim 11, wherein the trailing edge of the second voltage pulse is a falling edge.

13. An ink jet recording apparatus comprising:

a recording head having an energy generating element associated with a discharge port at which an ink meniscus forms, said energy generating element being capable of generating energy that discharges ink through said discharge port; and driving voltage control means for supplying a first voltage pulse to said energy generating element when ambient temperature is a predetermined temperature and a second voltage pulse when the ambient temperature is higher than said predetermined temperature, wherein the first and second voltage pulses have different waveforms and the falling edge of the second voltage pulse has a longer falling time than, and a gentler slope than, that of the first voltage pulse so that the second voltage pulse provides gentler restoration of the ink meniscus after ink discharge than the first voltage pulse.

14. An ink jet recording apparatus according to claim 13, further comprising an ambient temperature detecting means for detecting the ambient temperature of said ink jet recording head, wherein said control means is controlled to select the waveforms for the voltage pulses in accordance with a temperature detected by said detecting means

15. An ink jet recording apparatus according to claim 13, wherein said control means has two resistances each having a different resistance value and the waveform of the first voltage pulse and the waveform of the second voltage pulse are supplied by switching said resistances.

16. An ink jet recording apparatus according to claim 13, wherein said energy generating element is an electromechanical converting element.

* * * * *

UNITED STATES PATENT AND TRADEMARK OFFICE

CERTIFICATE OF CORRECTION

PATENT NO. : 4,980,699

DATED : December 25, 1990

INVENTOR(S) : SAKIKO TANABE, ET AL.

It is certified that error appears in the above-identified patent and that said Letters Patent is hereby corrected as shown below:

COLUMN 1

Line 19, "instructed" should read --constructed--.
Line 20, "is are" should read --is discharged from a discharge port on the basis of recording information, whereby flying ink droplets are--.
Line 21, "favored" should read --toward--.
Line 51, "path" should read --path,--.

COLUMN 2

Line 38, "the" (second occurrence) should be deleted.
Line 39, "phenomenon that" should be deleted.

COLUMN 4

Line 67, "FIG. 2B or" should read --FIG. 2B, or--.

UNITED STATES PATENT AND TRADEMARK OFFICE

CERTIFICATE OF CORRECTION

PATENT NO. : 4,980,699

DATED : December 25, 1990

INVENTOR(S) : SAKIKO TANABE, ET AL.

It is certified that error appears in the above-identified patent and that said Letters Patent is hereby corrected as shown below:

COLUMN 8

Line 20, "waveforms" should read --waveform--.

Signed and Sealed this

Thirtieth Day of June, 1992

*Attest:*

*Attesting Officer*

DOUGLAS B. COMER

*Acting Commissioner of Patents and Trademarks*